US010446307B2

(12) United States Patent
Loftus et al.

(10) Patent No.: US 10,446,307 B2
(45) Date of Patent: Oct. 15, 2019

(54) MAGNETIC FIELD GENERATORS BASED ON HIGH MAGNETIC PERMEABILITY MATERIALS

(71) Applicant: AOSense, Inc., Sunnyvale, CA (US)

(72) Inventors: Thomas H. Loftus, Los Gatos, CA (US); Mark A. Kasevich, Palo Alto, CA (US); Arman Cingoz, Sunnyvale, CA (US); Matthew Cashen, Gilroy, CA (US)

(73) Assignee: AOSense, Inc., Sunnyvale, CA (US)

( * ) Notice: Subject to any disclaimer, the term of this patent is extended or adjusted under 35 U.S.C. 154(b) by 0 days.

(21) Appl. No.: 15/603,020

(22) Filed: May 23, 2017

(65) Prior Publication Data

US 2018/0342339 A1 Nov. 29, 2018

(51) Int. Cl.

| | |
|---|---|
| ***H01F 3/10*** | (2006.01) |
| ***H01F 7/06*** | (2006.01) |
| ***H01F 1/12*** | (2006.01) |
| ***H01F 7/02*** | (2006.01) |
| ***H01F 3/14*** | (2006.01) |
| ***H01F 7/20*** | (2006.01) |

(52) U.S. Cl.
CPC ..... *H01F 7/06* (2013.01); *H01F 1/12* (2013.01); *H01F 3/10* (2013.01); *H01F 3/14* (2013.01); *H01F 7/0278* (2013.01); *H01F 7/20* (2013.01)

(58) Field of Classification Search
CPC .... H01F 7/0278; H01F 3/10; H01F 2003/103; H01F 3/14
See application file for complete search history.

(56) References Cited

U.S. PATENT DOCUMENTS 5,539,366 A * 7/1996 Dorri ..... G01R 33/3806 324/318
6,190,517 B1 * 2/2001 Davis ..... H01F 7/20 204/298.02
2001/0042824 A1 * 11/2001 Bouyer ..... H05H 3/02 250/251

FOREIGN PATENT DOCUMENTS

JP 60088407 A * 5/1985 ..... G01R 33/383

* cited by examiner

*Primary Examiner* — Ramon M Barrera
(74) *Attorney, Agent, or Firm* — Van Pelt, Yi & James LLP

(57) ABSTRACT

A device for magnetic field generation includes a flux deliverer and a field shaper.

15 Claims, 14 Drawing Sheets

MAGNETIC FIELD GENERATORS BASED ON HIGH MAGNETIC PERMEABILITY MATERIALS

This invention was made with government support under contract #HR0011-09-C-0116 awarded by DARPA. The government has certain rights in the invention

BACKGROUND OF THE INVENTION

Switchable magnetic fields with various geometries and magnitudes are required for laser cooling and atom optic devices. Examples include quadrupole magnetic fields for two dimensional magneto-optic traps (2D MOTs), spherical quadrupole magnetic fields for three-dimensional magneto-optic traps (3D MOTs), and spatially uniform, large volume bias magnetic fields for atom interferometers. The magnetic fields for laser cooling and atom optic devices are typically generated with conventional electromagnets that use current carrying wires wound onto coil forms. For conventional electromagnets, the field shape and magnitude are set by the drive current and the geometry and number of windings in the electromagnets. To satisfy size constraints and minimize power consumption, the coils are often placed inside vacuum chambers. This approach generates the requisite fields, but leads to several problems including waste heat generated by the coils and the resulting need for efficient heat sinking to avoid thermal runaway, outgassing from the wire insulation and associated hardware for connecting the wires to external current sources, and the challenge of diagnosing problems with in-vacuum components that cannot be accessed without opening the vacuum enclosure. The latter, in particular, can lead to costly or tedious repair cycles involving iterative repair and evacuation cycles. The design space to achieve a given magnetic field geometry with conventional electromagnets is also relatively limited; for example, bias fields with minimized gradients require coils pairs whose spacing is set by their length and width; maximizing the gradient versus drive current for a spherical quadrupole field also requires coil pairs whose spacing is set by their common radii. These limitations can lead, for space-confined in-vacuum volumes, to a limited number of windings and hence excessively large drive currents that, in turn, generate higher waste heat in the coils and thus more challenging in-vacuum thermal and outgassing problems.

BRIEF DESCRIPTION OF THE DRAWINGS

Various embodiments of the invention are disclosed in the following detailed description and the accompanying drawings.

DETAILED DESCRIPTION

Figure 1:
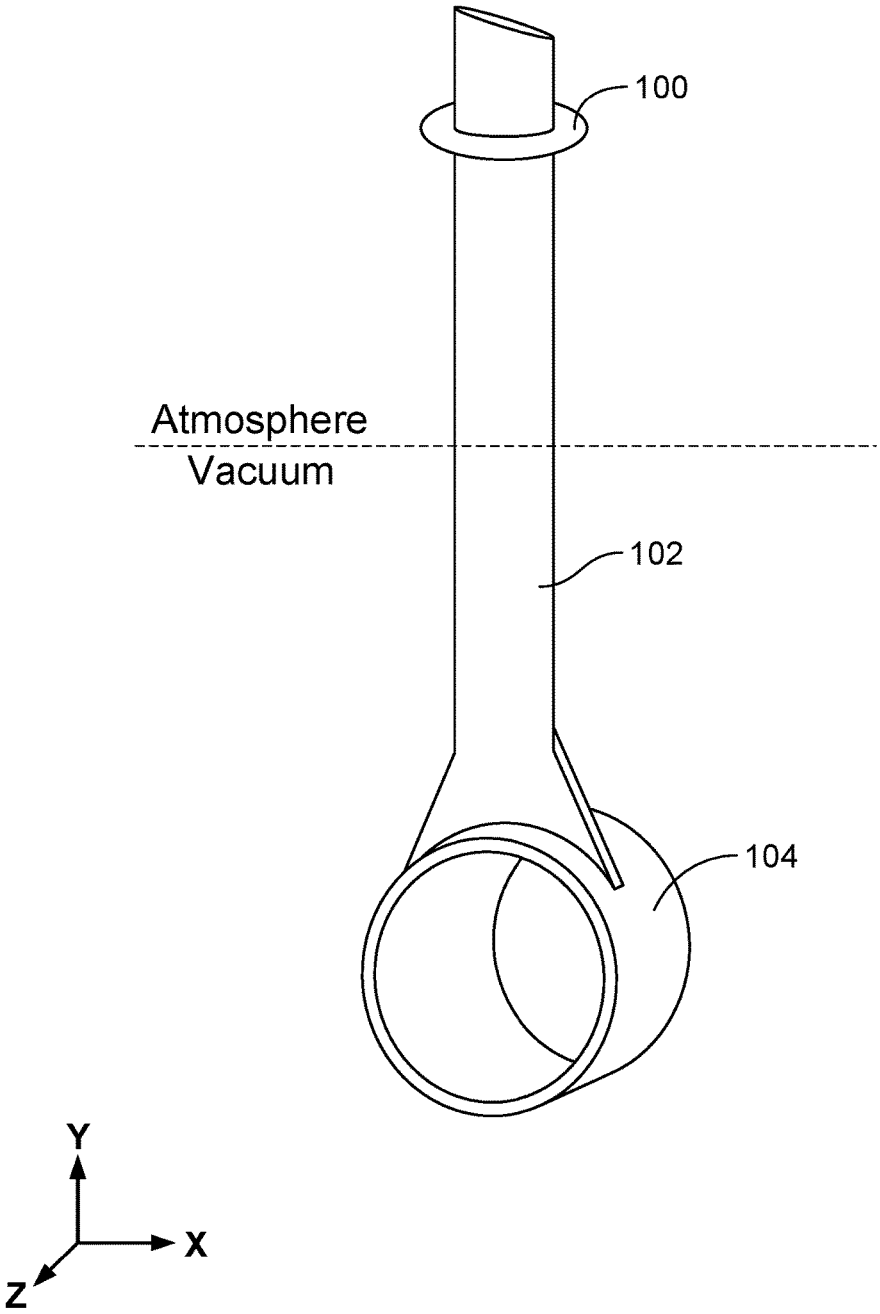
FIG. 1 is a diagram illustrating an embodiment of a device for magnetic field generation.

The invention can be implemented in numerous ways, including as a process; an apparatus; a system; a composition of matter; a computer program product embodied on a computer readable storage medium; and/or a processor, such as a processor configured to execute instructions stored on and/or provided by a memory coupled to the processor. In this specification, these implementations, or any other form that the invention may take, may be referred to as techniques. In general, the order of the steps of disclosed processes may be altered within the scope of the invention. Unless stated otherwise, a component such as a processor or a memory described as being configured to perform a task may be implemented as a general component that is temporarily configured to perform the task at a given time or a specific component that is manufactured to perform the task. As used herein, the term 'processor' refers to one or more devices, circuits, and/or processing cores configured to process data, such as computer program instructions.

A detailed description of one or more embodiments of the invention is provided below along with accompanying figures that illustrate the principles of the invention. The invention is described in connection with such embodiments, but the invention is not limited to any embodiment. The scope of the invention is limited only by the claims and the invention encompasses numerous alternatives, modifications and equivalents. Numerous specific details are set forth in the following description in order to provide a thorough understanding of the invention. These details are provided for the purpose of example and the invention may be practiced according to the claims without some or all of these specific details. For the purpose of clarity, technical material that is known in the technical fields related to the invention has not been described in detail so that the invention is not unnecessarily obscured.

A device for magnetic field generation is disclosed. The device includes a flux deliverer and a field shaper. In various embodiments, the flux deliverer delivers a magnetic field from an electromagnet or a permanent magnet. In the event that electromagnets are used, the magnetic field is electrically switchable. This extra degree of freedom comes at the cost of the complexity associated with the electromagnets. In the event that permanent magnets are used, the field is not switchable, but has the advantage of greater simplicity—the magnetic field is set during assembly and does not require power supplies or control electronics afterward. In some embodiments, the flux deliverer comprises a material with high magnetic permeability. In some embodiments, the field shaper is shaped to generate a desired magnetic field at a spatial location remote from the electromagnets. In various embodiments, the field shaper shapes a dipole magnetic field, a quadrupole magnetic field, a spherical quadrupole magnetic field, a bias field, or any other appropriate field shape.

In some embodiments, a device for generating magnetic fields is disclosed that overcomes the limitations of conventional electromagnets for atom optic and other devices by combining high magnetic permeability materials with simple electromagnetic solenoids. For these devices, the magnetic flux is generated outside of a vacuum chamber and then transported inside via high permeability materials (e.g., mu-metal, permalloy, or other appropriate material); the shape of the magnetic field inside the vacuum chamber is then set by the geometry for the high-permeability material at the point where it's terminated. These devises may also transport the magnetic flux within a given vacuum chamber, between vacuum chambers, or completely outside of a vacuum chamber. For simplicity, the high-permeability material is referred to as mumetal in the following. However, it should be obvious to a practitioner of the art that the designs can use any high-permeability material that can be machined, molded, cast, sintered, or ground to form target shapes. The primary advantages for the approach are: (1) the shape and number of turns for the electromagnets is separated from the shape and magnitude of the desired magnetic field; The windings can, for example, be simple solenoids while the target field is a spherical quadrupole, (2) the heat-generating electromagnets can be located outside the vacuum chamber, which simplifies heat sinking the coils, enables the use of inexpensive magnet wire, and provides easy access for trouble-shooting the coils or other active components of the magnetic field-generating system, and (3) the boundary conditions enforced by the mumetal can, in cases such as bias fields, make the B-field geometry less sensitive to the detailed shape or placement of sub-components in the field-generating structures.

In some embodiments, the field shaper has cutouts to enable optical access. In some embodiments, the field shaper includes cutouts to shape the magnetic field and enable optical access. In some embodiments, the cutouts comprise circular cutouts. In various embodiments, the field shaper comprises one or more of the following shapes with or without cutouts: a ring, a cylinder, a sphere, a plate, a slab, a rectangular solid, or any other appropriate shape.

In some embodiments, the delivery of flux to a field shaper is in either direction (e.g., delivery to or return of the magnetic field to a field shaper). In the description that follows, the terms delivery or return/retrieve/receive are used to describe the direction of the magnetic field, however, a person practiced in the art would understand that the direction of the magnetic field is arbitrary and the flux can be transmitted to/from a source/sink to/from a field shaper. As such, the terms deliver, return, retrieve, receive, or transmit should be thought of as being interchangeable for the following discussion. In some embodiments, delivery of flux can be in either direction so that the magnetic field points in the direction of the delivery or against the direction of the delivery.

FIG. 1 is a diagram illustrating an embodiment of a device for magnetic field generation. In the example shown, the device includes electromagnet 100, flux deliverer 102, and field shaper 104. Electromagnet 100 comprises a one or more wire coils to generate a magnet field using electric current in the one or more wire coils. The magnetic field propagates through flux deliverer 102 to field shaper 104. The field shaper generates a quadrupole magnetic field (e.g., for a three-dimensional magneto-optical trap (3D MOT)). Flux deliverer 102 channels the flux from outside to inside a vacuum chamber. The quadrupole field forms in the center of the cylinder. In the x-y plane and inside the cylinder, the field is constrained to be radial by boundary conditions set by the shape of field shaper 104 (e.g., the cylindrical mumetal walls), which force the magnetic field to be normal to the surface of the mumetal at the point where the magnetic field and the surface of the mu-metal are coincident. Along the z-axis, the field is then dispersive as a result of Gauss's law for magnetostatics (e.g., Del dot B=0). In some embodiments, flux deliverer 102 is welded to field shaper 104. In some embodiments, flux deliverer 102 is connected to field shaper 104 in a manner such that the magnetic flux traverses the connection. In various embodiments, flux deliverer 102 and field shaper 104 are made from a high permeability material (e.g., mumetal, permalloy, or any other appropriate material). In some embodiments, flux deliverer 102 and field shaper 104 are machined, cut, ground, or cast from a single piece of material.

In some embodiments, the flux deliverer 102 transitions into a vacuum chamber by penetrating the vacuum chamber (e.g., through a hole surrounded by a magnetic insulator and a vacuum tight seal).

Figure 2:
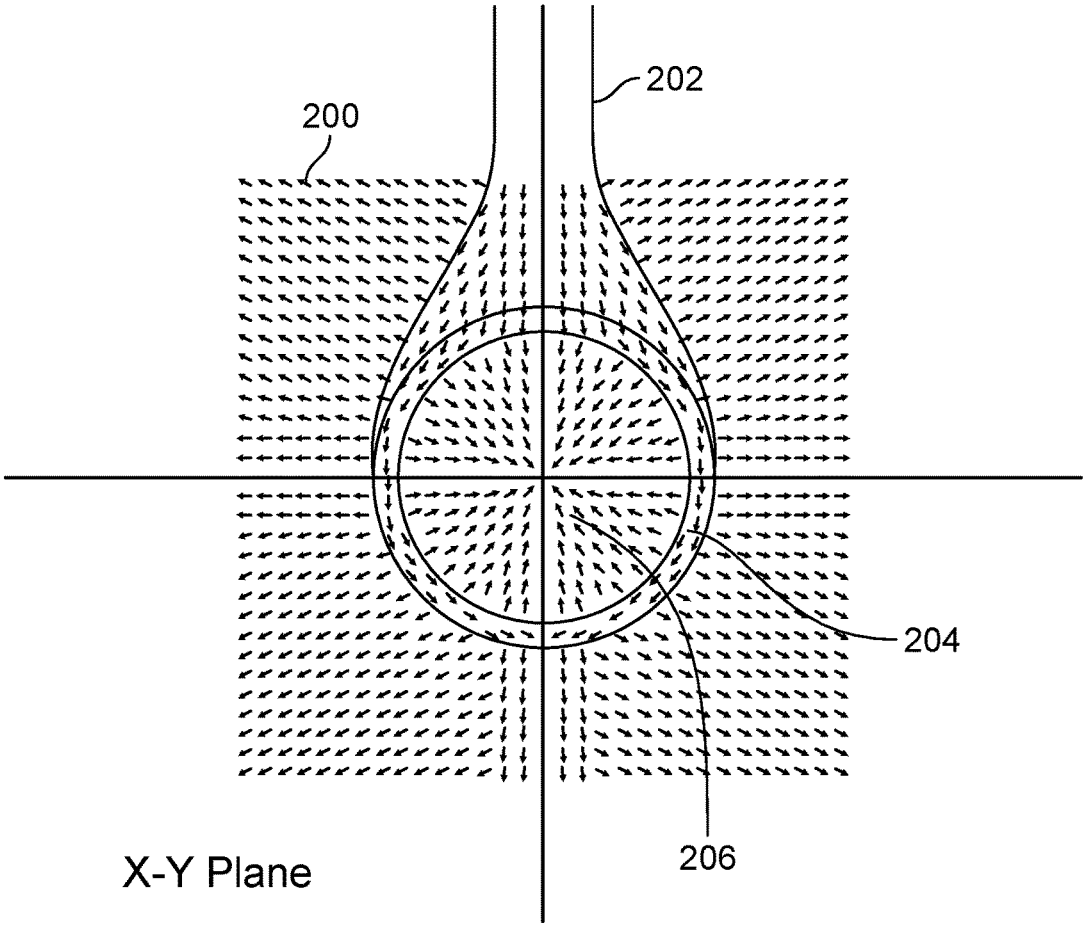
FIGS. 2 and 3 are diagrams illustrating embodiments of analysis models of a device for magnetic field generation.
Figure 3:
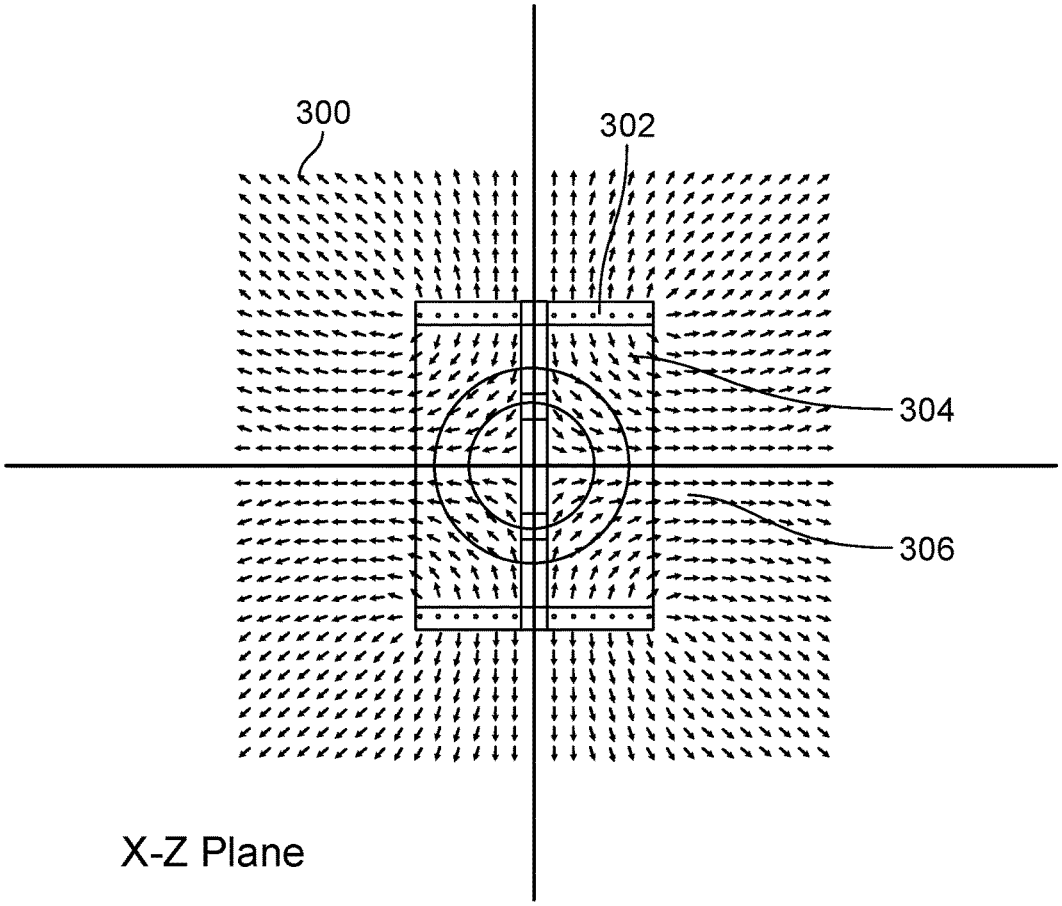

FIGS. 2 and 3 are diagrams illustrating embodiments of analysis models of a device for magnetic field generation. In some embodiments, the models of FIGS. 2 and 3 are for a device as in FIG. 1. In the example shown in FIG. 2, arrows 200 represent the direction of a magnetic field in the x-y plane for a plane intersecting the center of a device. Flux deliverer 202 delivers magnetic flux to field shaper 204. Magnetic flux flows down flux deliverer 202 and couples to a cylinder shape of field shaper 204. In some embodiments, flux deliverer 202 is welded to field shaper 204. In some embodiments, flux deliverer 202 and field shaper 204 are machined, cut, ground, or cast from a single piece of material. In various embodiments, flux deliverer 202 and field shaper 204 are made from a high permeability material (e.g., mumetal, permalloy, or any other appropriate material). In some embodiments, the model comprises a finite element analysis (FEA) model of the magnetic field. In the plot, the origin is coincident with the geometric center of the cylinder.

In the example shown in FIG. 3, arrows 300 represent the direction of a magnetic field in the x-z plane for a plane intersecting the center of a device. A flux deliverer delivers magnetic flux to field shaper 302. Magnetic flux flows down the flux deliverer and couples to a cylinder shape of field shaper 302. For example, the flux travels into the page in the cross section of field shaper 302 as viewed from the top. The magnetic flux propagates away from field shaper 302 in the direction of arrow 304 and then away from center of field shaper 302 along arrow 306. In some embodiments, the flux deliverer is welded to field shaper 302. In some embodiments, the flux deliver and field shaper 301 are machined, cut, ground, or cast from a single piece of material. In various embodiments, flux deliverer and field shaper 302 are made from a high permeability material (e.g., mumetal, permalloy, or any other appropriate material).

Figure 4:
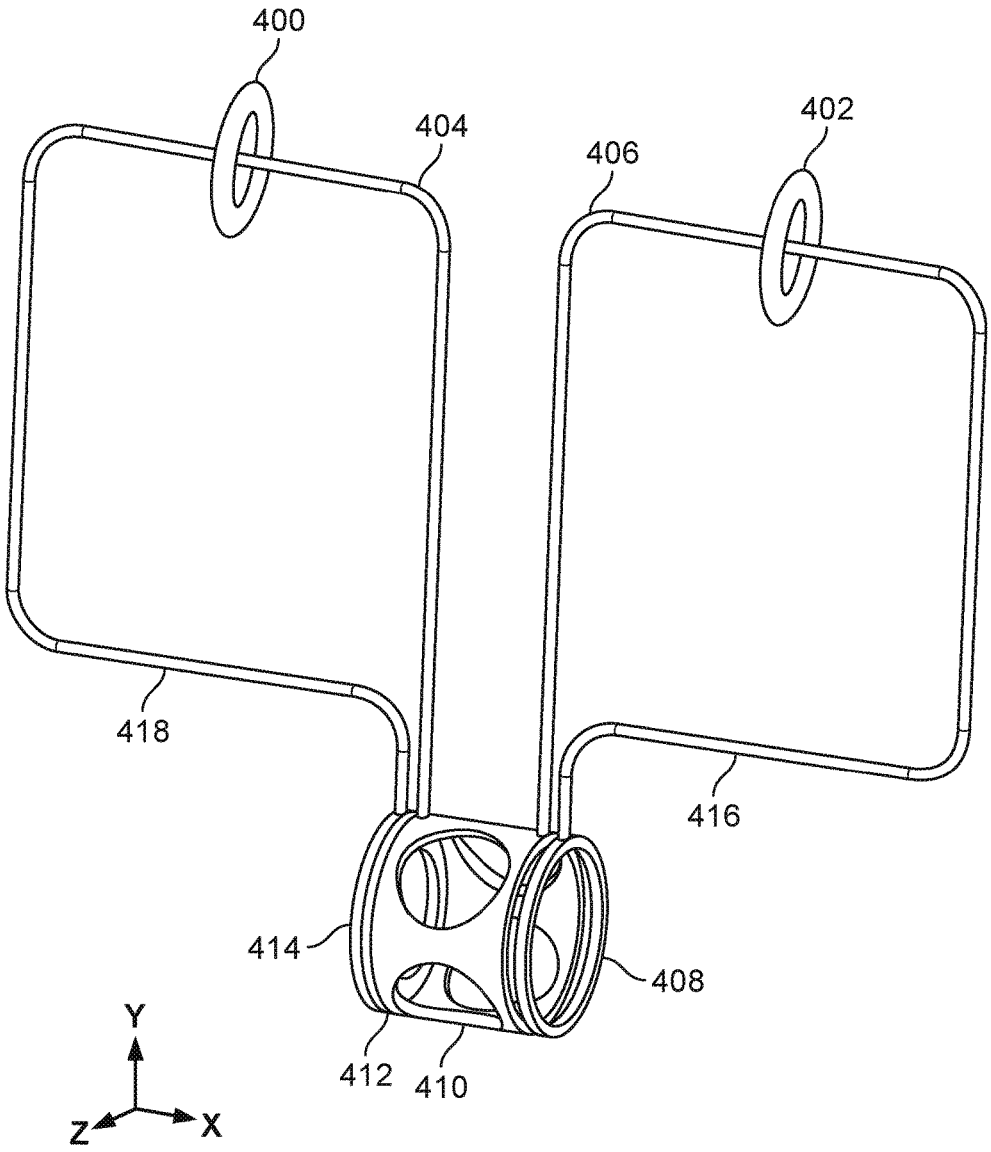
FIG. 4 is a diagram illustrating an embodiment of a magnetic field generation device.

FIG. 4 is a diagram illustrating an embodiment of a magnetic field generation device. In the example shown, a device for the generation of a spherical quadrapole magnetic field is shown. 3D MOTs use optical beams with k-vector projections along the three orthogonal axes where the axes are aligned such that the magnetic field is radial and has the same polarity along two axes and is radial (or dispersive) and has the opposite polarity along the third. For the right-handed coordinate system of FIG. 4, the magnetic field is radial and has the same polarity along the y and z-axes and is radial and has the opposite polarity along the x-axis. Field shaper 414, field shaper 410, and field shaper 408 generate a spherical quadrapole magnetic field for a 3D-MOT. The device shown provides the necessary optical access, is tailored for ease of manufacturing, and includes magnetic flux returns that minimize the magnitude for stray fields outside the trapping region. The devise comprises field shaper 410 shaped as a cylinder with holes for the transverse trapping beams with two doughnut-shaped flux returns (e.g., field shaper 414 and field shaper 408). Electromagnet 400 and electromagnet 402 generate magnetic flux that is delivered using flux deliverer 404 and flux deliverer 406 to the field shaper 410. Magnetic flux is returned using flux return 416 from field shaper 408 and using flux return 418 from field shaper 414. In some embodiments, flux deliverer 404, flux deliverer 406, flux return 416, and flux return 418 as well as field shaper 414, field shaper 410, and field shaper 408 are made using a high magnetic permeability material (e.g., permalloy, mumetal, etc.). In some embodiments, electromagnets (e.g., electromagnet 400 and electromagnet 402 are wound directly onto flux deliverers/flux returns (e.g., flux deliverer 404, flux deliverer 406, flux return 416, or flux return 418). In some embodiments, the cylindrical field shaper is machined from rod or other stock and the flux deliverers are cut from a high magnetic permeability sheet or wire. In some embodiments, the flux deliverers are welded to field shapers. In some embodiments, the flux deliverers and field shapers are machined, cut, ground, or cast from a single piece of material. In some embodiments, holes for the transverse optical beams are placed at equal angular intervals about the cylinder axis to minimize perturbations to the field shapes. Spacer 412 separates field shaper 414 from field shaper 412. Spacer 412 comprises a material with low magnetic permeability that does not significantly re-direct the magnetic flux.

In some embodiments, a field shaper includes holes placed at angular intervals of 360°/n where n=4, although n=2, 3, 4, 5 also preserves the FIG. 1 field shapes. The flux deliverers are attached at the ends of the cylinder to make room for the holes while preserving symmetric injection of the magnetic flux. The flux returns (e.g., field shaper 414 and field shaper 408) close the 'magnetic circuit' and cause stray field produced by the cylinder to decrease more quickly than they would otherwise.

Figure 5:
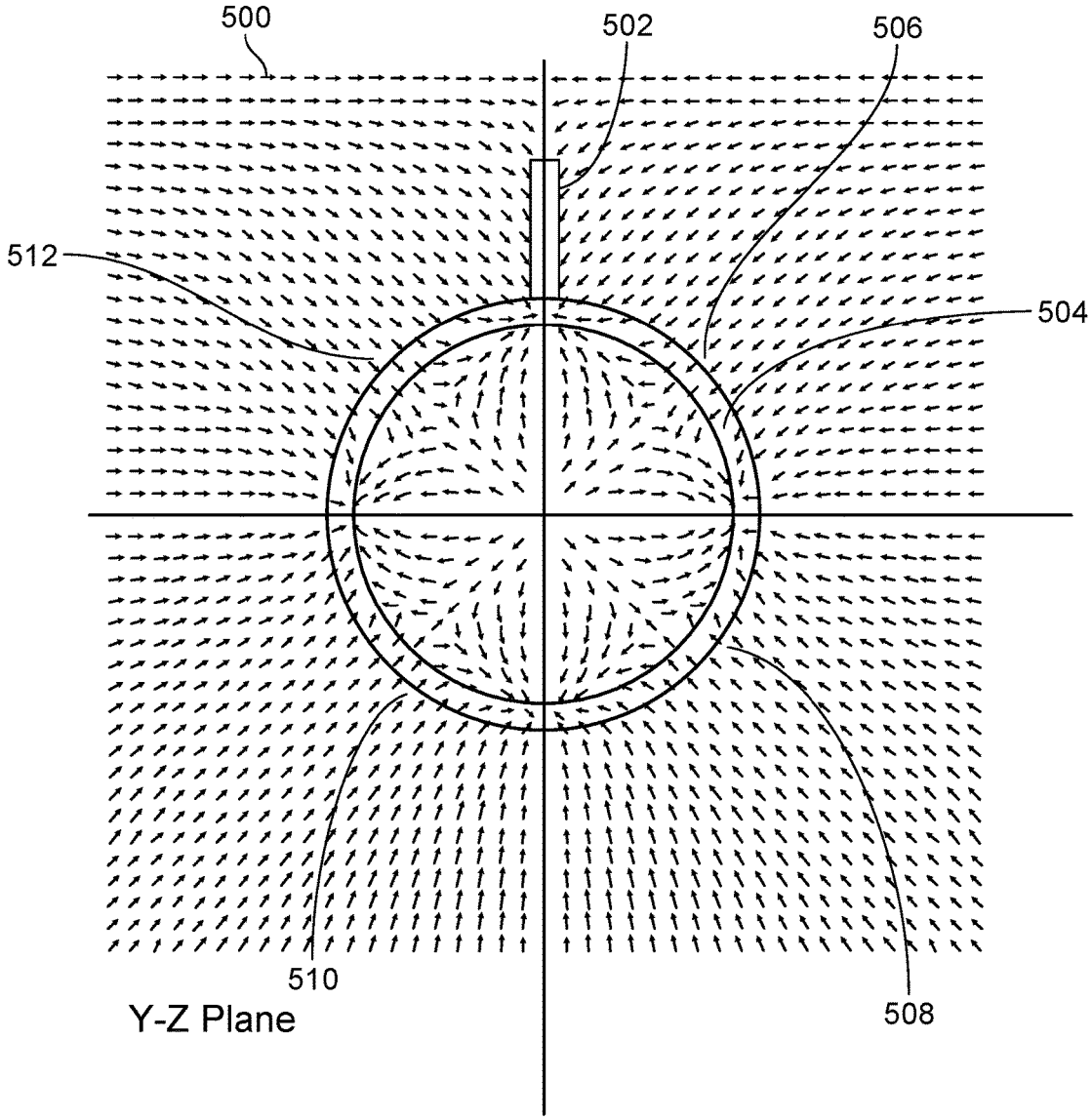
FIGS. 5 and 6 are diagrams illustrating embodiments of analysis models of a device for magnetic field generation.
Figure 6:
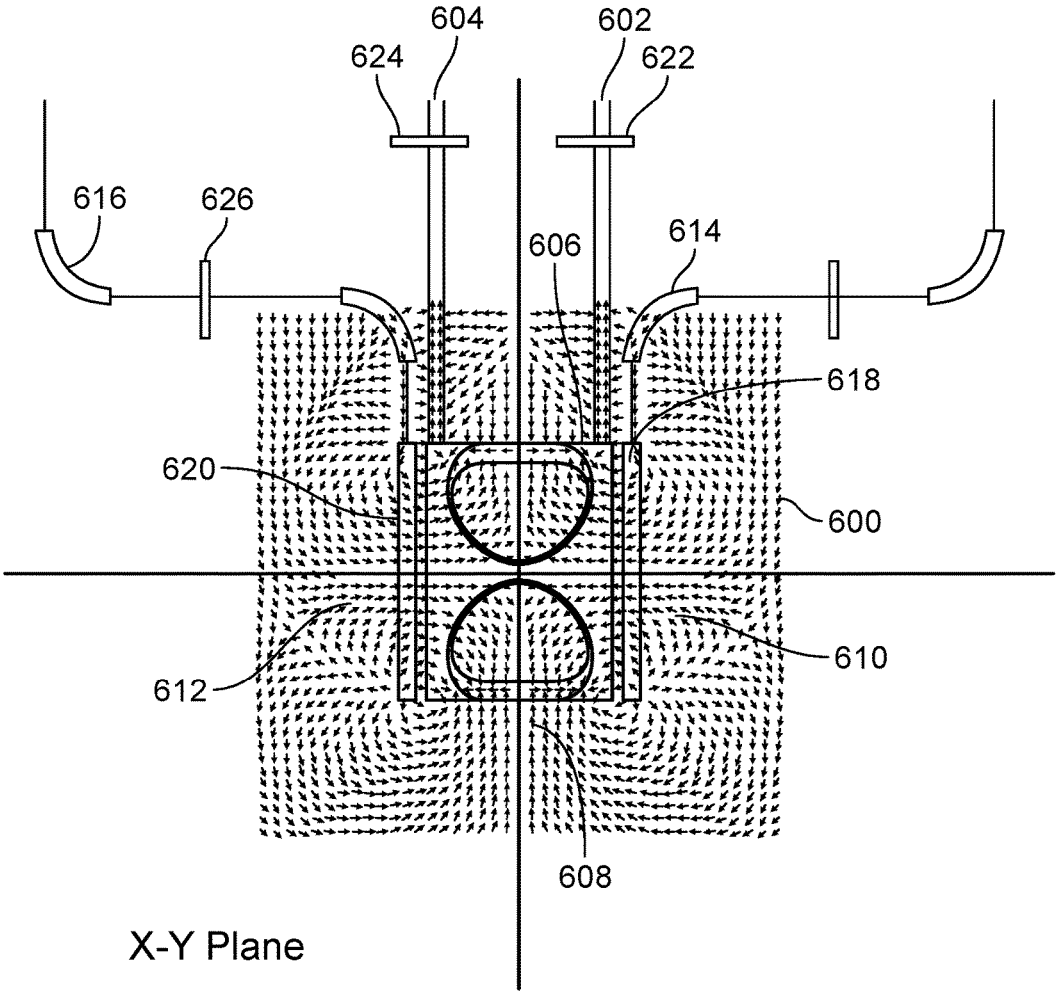

FIGS. 5 and 6 are diagrams illustrating embodiments of analysis models of a device for magnetic field generation. In some embodiments, the models of FIGS. 5 and 6 are for a device as in FIG. 4. In the example shown in FIG. 5, arrows 500 represent the direction of a magnetic field in the y-z plane for a plane intersecting the center of a device. Flux returner 502 returns magnetic flux from field shaper 504. Magnetic flux flows up flux returner 502 and couples to the cylinder shape of field shaper 504. In some embodiments, flux returner 502 is welded to field shaper 504. In some embodiments, flux returner and field shaper 504 are machined, cut, ground, or cast from a single piece of material. In various embodiments, flux returner 502 and field shaper 504 are made from a high permeability material (e.g., mumetal, permalloy, or any other appropriate material). In some embodiments, the model comprises a finite element analysis (FEA) model of the magnetic field. In the plot, the origin is coincident with the geometric center of the cylinder. The magnetic field lines enter the space inside field shaper 504 through apertures near location 506, location 508, location 510, and location 512 and from any appropriate field shaper(s), which receives magnetic flux from flux deliverer(s) and/or delivers magnetic flux to flux returner(s).

In the example shown in FIG. 6, arrows 600 represent the direction of a magnetic field in the x-y plane for a plane intersecting the center of a device. Magnetic flux is delivered by flux deliverer 602 and flux deliverer 604 to field shaper 606. Magnetic flux flows up flux return 602 and flux return 604 and couples to a cylinder shape of field shaper 606. For example, the flux travels up the page from the field shaper 606 as viewed from the side. The magnetic flux propagates into or out of field shaper 606 in the direction of arrow 608, arrow 610, and arrow 612. Magnetic flux is delivered using flux deliverer 614 to field shaper 618. Magnetic flux is returned using flux return 616 to field shaper 620. In some embodiments, the flux deliverer is welded to field shaper. In some embodiments, the flux deliverers and field shaper are machined, cut, ground, or cast from a single piece of material. In various embodiments, flux return 614, flux return 616, flux deliverer 602, and/or flux deliverer 604 is/are made from a high permeability material (e.g., mumetal, permalloy, or any other appropriate material).

In some embodiments, magnetic flux is generated by an electromagnet (e.g., electromagnet 622 for flux return 602, electromagnet 624 for flux return 604, electromagnet 626 for flux deliverer 616, or electromagnet 628 for flux deliverer 614). In some embodiments, separate electromagnets are used for each field shaper for magnetic field tuning. In some embodiments, magnetic flux is generated with permanent magnets.

Figure 7A:
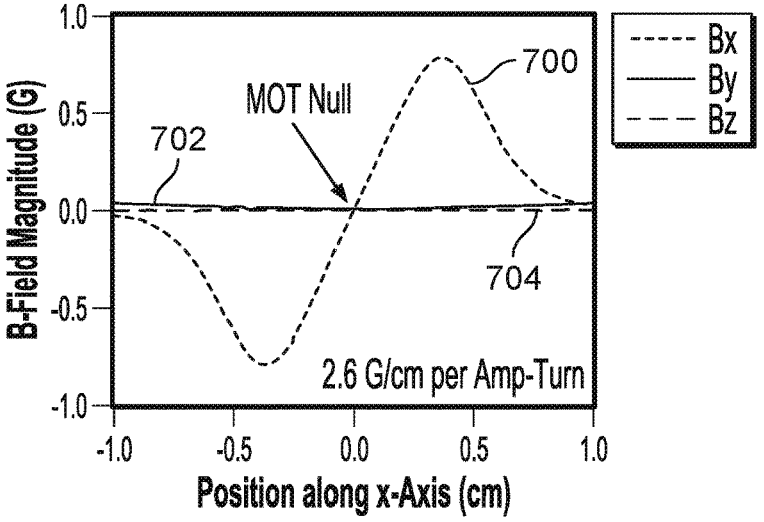
FIGS. 7A, 7B, and 7C are graphs illustrating embodiments of line plots of the three components of the magnetic field along the x, y, and z axes for a magnetic field generating device.
Figure 7B:
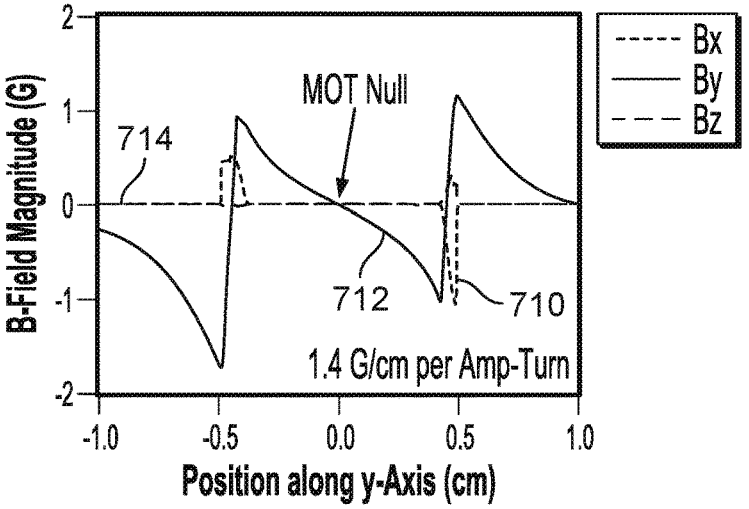
Figure 7C:
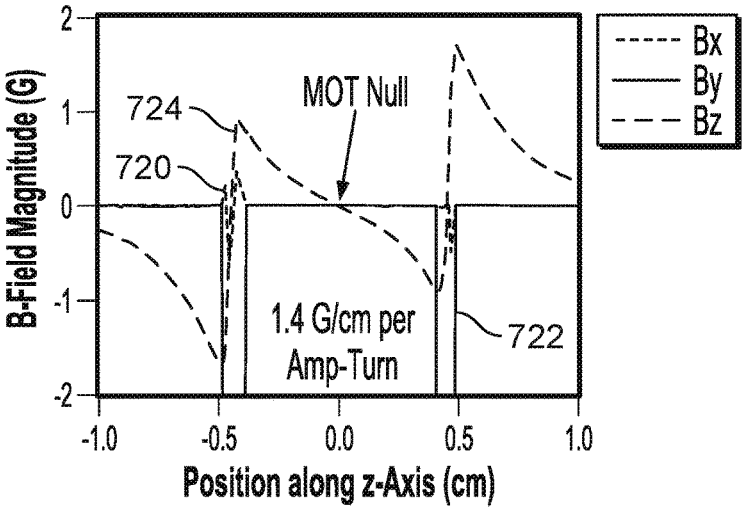

FIGS. 7A, 7B, and 7C are graphs illustrating embodiments of line plots of the three components of the magnetic field along the x, y, and z axes for a magnetic field generating device. In some embodiments, the graphs show the magnetic fields associated with a magnetic field generating device similar to FIG. 4. In the examples shown, the origin is coincident with the geometric center of the cylinder in FIG. 4. The magnetic field inside the cylinder is a spherical quadrupole, as required for a 3D MOT. FIG. 7A shows the fields along the x axis—for example, trace 700 is the component of the magnetic field in the x direction and trace 702 and trace 704 are the components of the magnetic fields in the y and z directions, respectively. FIG. 7B shows the fields along the y axis—for example, trace 710 is the component of the magnetic field in the x direction and trace 712 and trace 714 are the components of the magnetic fields in the y and z directions, respectively. FIG. 7C shows the fields along the z axis—for example, trace 720 is the component of the magnetic field in the x direction and trace 722 and trace 724 are the components of the magnetic fields in the y and z directions, respectively.

Figure 8A:
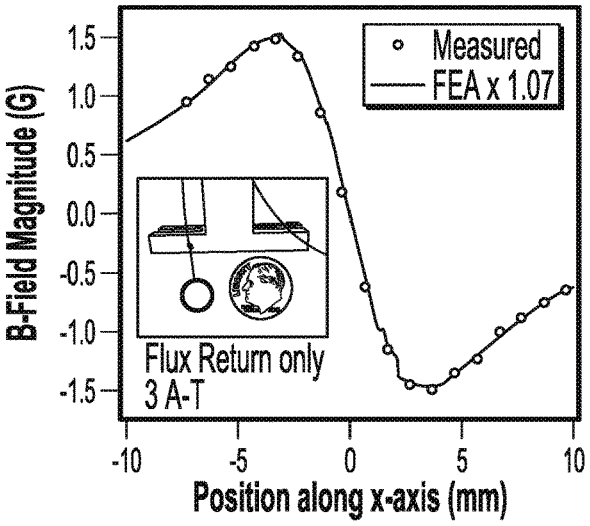
FIGS. 8A, 8B, and 8C are graphs illustrating embodiments of line plots of the magnetic field along an axis for a magnetic field generating device.
Figure 8B:
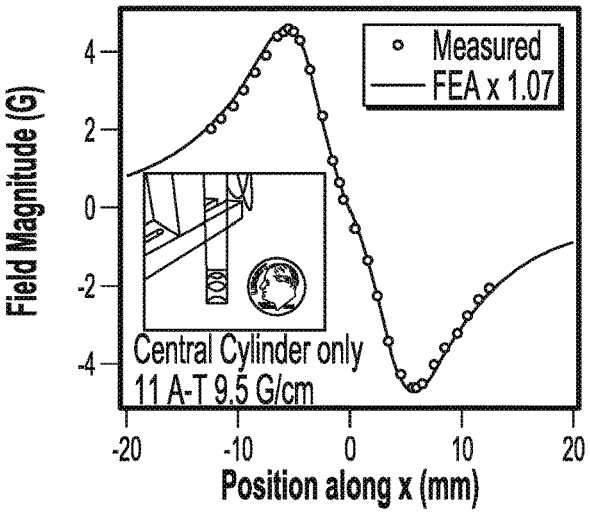
Figure 8C:
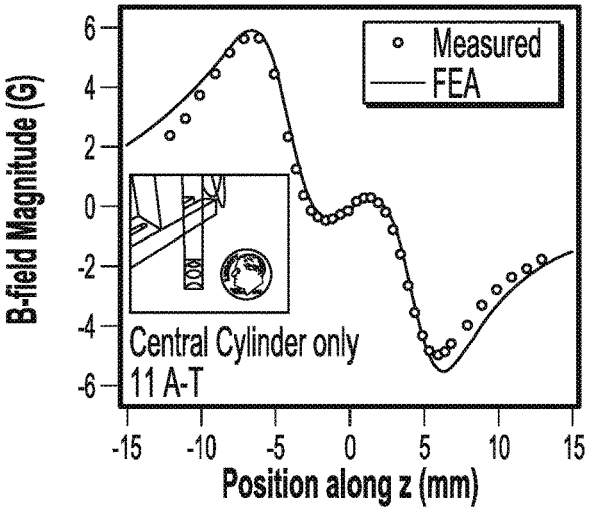

FIGS. 8A, 8B, and 8C are graphs illustrating embodiments of line plots of the magnetic field along an axis for a magnetic field generating device. In the examples shown in FIG. 8A, the measured axial magnetic field is shown for a field shaper similar to an end field shaper of FIG. 4 (e.g., field shaper 408 or field shaper 414). In the examples shown in FIGS. 8B and 8C, the measured axial magnetic field is shown for a field shaper similar to the center field shaper of FIG. 4 (e.g., field shaper 410). FIG. 8B shows the measured magnetic field for the central cylinder along the axis of the cylinder. FIG. 8C shows the measured magnetic field for the central cylinder along the axis for one set of the transverse holes. In the plots, dots (the lines) are the measured (FEA-predicted) magnetic fields. The measured and FEA-predicted fields are in good agreement. For these measurements, the electromagnets were wound directly onto mumetal wire, which acted as the field deliverer. The insets in FIGS. 8A, 8B, and 8C are images of the field shapers, along with a United States Dime for scale.

In some embodiments, the tested devices comprised flux couplers, flux delivers, and flux shapers. In these cases, electromagnets were wound onto the flux couplers, which were then in physical contact with the flux delivers. In some embodiments, the flux couplers were comprised of high magnetic permeability material. The magnetic flux was first captured by the flux couplers, then delivered to the flux delivers, and subsequently delivered to the flux shapers. In some embodiments, the transfer efficiency from the couplers and into the delivers can depend on the details for the coupler-deliver interfaces and can drop by >30% if the devices are separated by 0.01" rather than flush. It can also depend on the shape and surface quality of the surfaces at the interface. Example interface shapes are planar-planar, mutually tipped planar-planar, cone-planar, and so on. In some embodiments, the electromagnets are wound directly onto the flux delivers. The electromagnets are wound separately for the central cylinder and the flux returns. This approach has several potential advantages: (1) enables tuning the location of the MOT null and hence provides a means to address, e.g., shape non-idealities for the central cylinders that could otherwise hard-wire offsets into the magnetic field nulls, (2) reduces the volume for the electromagnets and increases the flexibility for positioning the mumetal feedthroughs on the atmospheric side of the vacuum chamber, and (3) simplifies assembly and reduces part count; for example, more than 20 turns of magnet wire can be wound by hand onto the mumetal flux delivers in a few minutes.

Figure 9A:
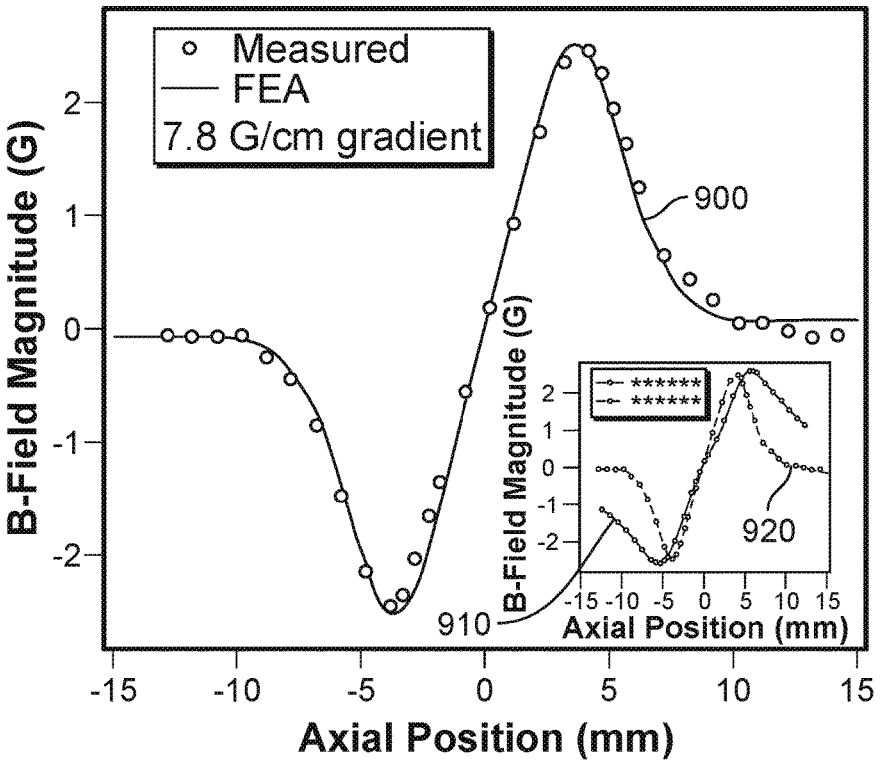
FIG. 9A is graph illustrating an embodiment of a measured and finite element analysis (FEA)-predicted magnetic field for a 3D MOT field generator with the flux returns installed.

FIG. 9A is graph illustrating an embodiment of a measured and FEA-predicted magnetic field for a 3D MOT field generator with the flux returns installed. In some embodiments, the device measured is similar to the device of FIG. 4. In the example shown, dots of trace 900 and trace 920 are the measured magnetic fields; the lines of trace 900 and trace 920 are the finite element analysis model of the magnetic fields; the measurements and model are in good agreement. The inset compares the measured axial magnetic field with and without the flux returns (trace 920 and trace 910, respectively). As shown in the plots, the returns cause the field to decrease faster outside the central cylinder used for the 3D MOT (leading to reduced cross-talk with adjacent traps, atom interferometers, or other atom-optic devices), increases the axial gradient, and eliminates the small drop in the gradient near the center of the trap (i.e., the slight kink around +/−2 mm in FIG. 8B).

Figure 9B:
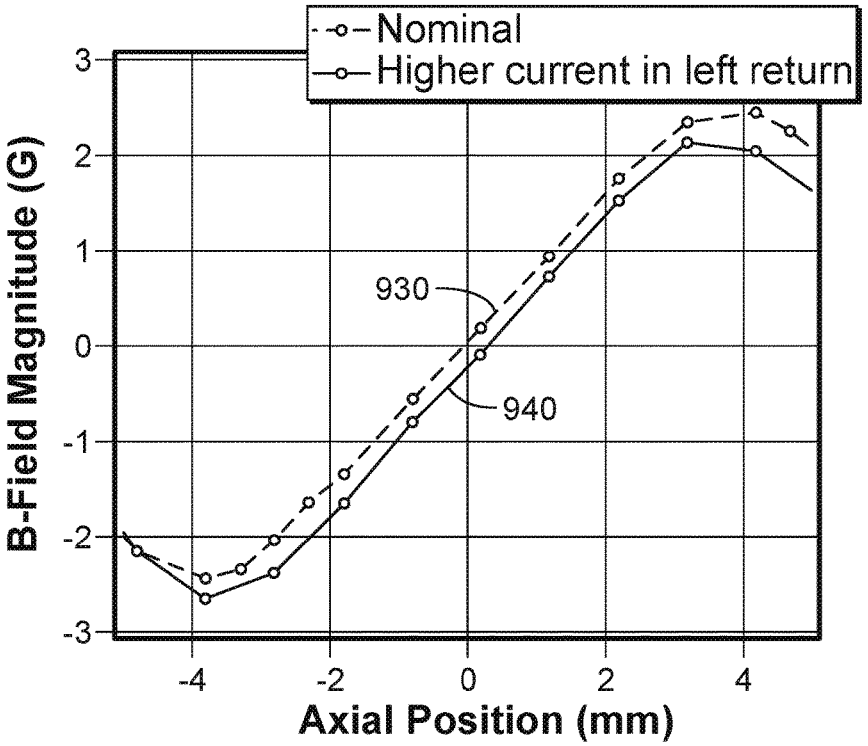
FIG. 9B is graph illustrating an embodiment of a device for magnetic field generation.

FIG. 9B is graph illustrating an embodiment of a device for magnetic field generation. In some embodiments, the device measured is similar to the device of FIG. 4. In the example shown, the drive current for the flux returns (e.g., the field shapers at the outside of the field generation device—similar to field shaper 414 and field shaper 408 of FIG. 4) can be used to tune the location of the B-field or alternatively, trap null. In the figure, trace 930 is the measured axial field near the center of the trap when the current for the returns is balanced. Trace 940 is the measured axial field near the center of the trap when the current for the returns is deliberately mismatched by a factor of 2. The respective field nulls are separated by 0.3 mm while the gradients are roughly equal.

In some embodiments, hysteresis in the high-permeability structures can lead to remnant fields when the field generators are turned off. This effect is checked by placing a magnetic field probe at one of the axial field maxima and then driving the electromagnets with the sequence +0−0+0−0 where +(−) is positive (negative) signed current and 0 represents the current is off. For an on-state gradient of 9.5 G/cm, the average off-state gradient was around 150 mG/cm. This is suitably small to correct by applying small 'opposite' signed currents during the off time.

Figure 10:
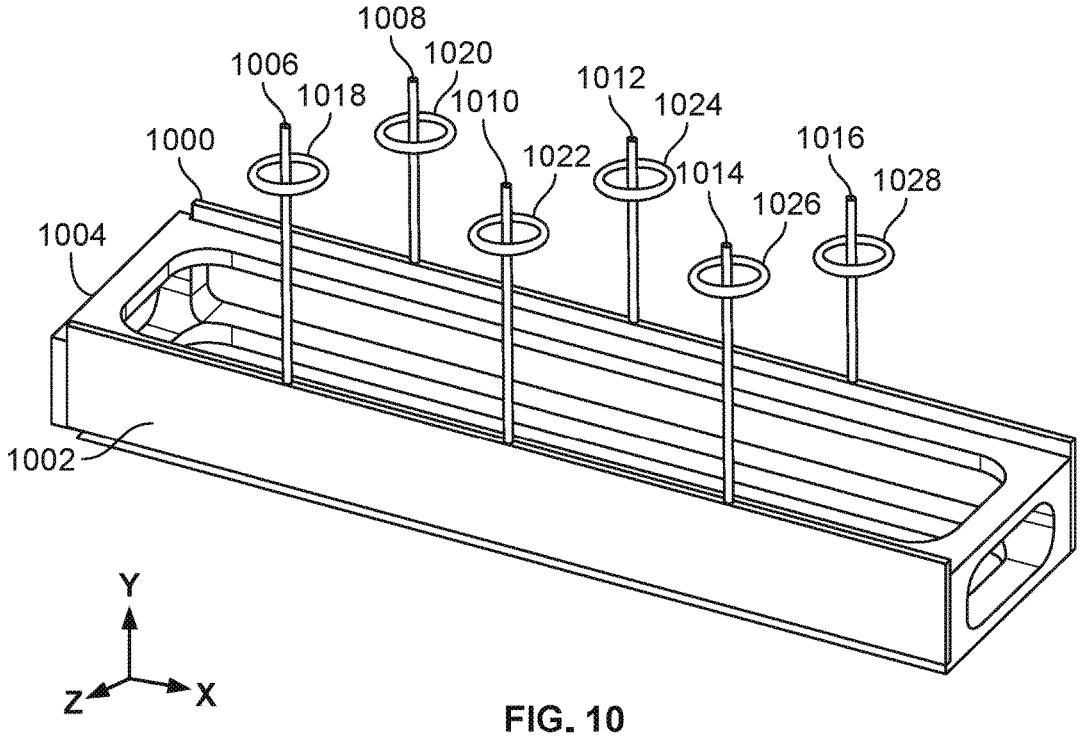
FIG. 10 is a diagram illustrating an embodiment of a magnetic field generator.

FIG. 10 is a diagram illustrating an embodiment of a magnetic field generator. In the example shown, field shaper 1000 and field shaper 1002 make a uniform, transverse bias field (e.g., useful for atom interferometers). Field shaper 1000 and field shaper 1002 comprise flat plates or strips that are separated using central frame 1004. Flux deliverers 1008, flux deliverer 1012, flux deliverer 1016 deliver flux to field shaper 1000 from electromagnet 1020, electromagnet 1024, and electromagnet 1028, respectively. Flux retriever 1006, flux receiver 1010, flux receiver 1014 retrieve flux from field shaper 1002 using electromagnet 1018, electromagnet 1022, and electromagnet 1026, respectively. The device is comprised of high magnetic permeability material (e.g., the flux deliverers, flux retrievers, and field shapers are all made from mumetal). In this case, the terminating structures are strips. The bias field is normal to the face of the strips. Central frame 1004 is used to position the strips for open air applications; other frames would hold the strips inside a vacuum chamber. In various embodiments, a frame is inside a vacuum chamber or is not inside a vacuum chamber. This configuration has an advantage over conventional electromagnetic bias coils: boundary conditions force the field lines to be normal to the mumetal strips whereas in the case of wires, they ultimately have to curl around the wires (so there will always be a transition from parallel to curling field lines). As a result the field shape and associated gradients generated by the FIG. 10 field generator are less sensitive to the dimensions or spacing between the strips, so it's possible to make spatially uniform fields without having to use—for example, the dimensions for a Helmholtz pair.

In some embodiments, the magnetic field generator of FIG. 10 includes cutouts to allow optical access into the space with the bias field. In some embodiments, an advantage of a bias field generator made out of mumetal, as opposed to electromagnets, is that because the magnetic field has to satisfy specific boundary conditions at the mumetal surfaces, it reduces the susceptibility to external magnetic fields. When there is an external field present, the presence of the mumetal distorts the external field such that the resultant fields are very similar to the desired applied field. The only real change is in the field amplitude, which is less important for the operation of some instruments (e.g., an atom interferometer). Of course, it is not a fully enclosed structure like a real magnetic shield, but it does add some extra "shielding" in the sense described above.

In some embodiments, the bias magnetic field is negligibly impacted at a healing length distance away from cutouts in the field shaper—the healing length distance is approximately equal to the largest dimension of the cutout.

Figure 11:
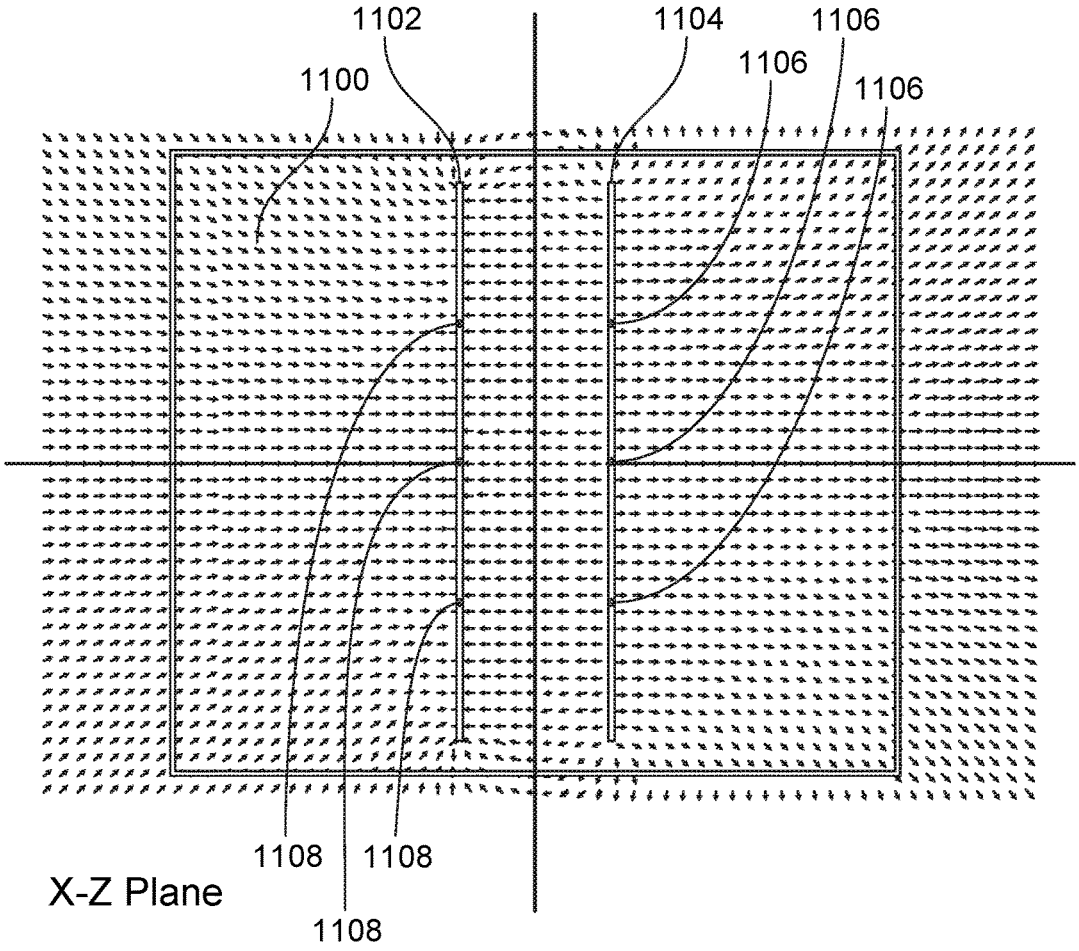
FIGS. 11 and 12 are diagrams illustrating embodiments of magnetic fields associated with a bias magnetic field generator.
Figure 12:
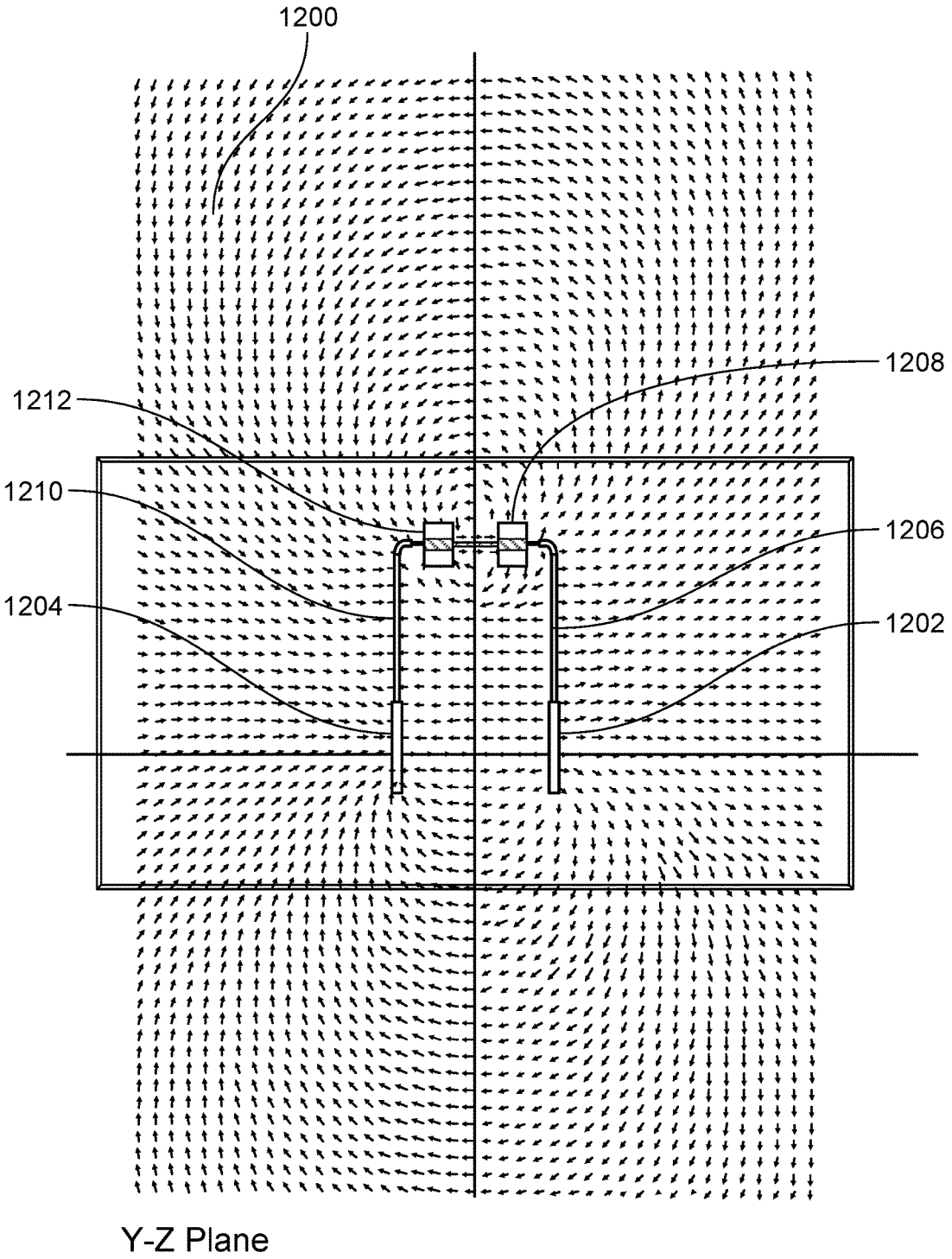

FIGS. 11 and 12 are diagrams illustrating embodiments of magnetic fields associated with a bias magnetic field generator. In some embodiments, the diagrams of FIGS. 11 and 12 are associated with a device similar to FIG. 10. In the example shown in FIG. 11, magnetic field directions are shown using arrows (e.g., arrow 1100). The magnetic fields are field element analysis calculated maps of the magnetic field in the x-z plane. The x-z plane passes through the center of the plates along the y-axis. Field shaper 1102 and field shaper 1104 comprise plates. Flux deliverers 1106 deliver flux to field shaper 1104. Flux receivers 1108 retrieve flux from field shaper 1102. The bias magnetic field is spatially uniform and over the region between field shaper 1102 and field shaper 1104.

In the example shown in FIG. 12, magnetic field directions are shown using arrows (e.g., arrow 1200). The magnetic fields are field element analysis calculated maps of the magnetic field in the y-z plane. The y-z plane passes through the center of the plates along the x-axis. Field shaper 1202 and field shaper 1204 comprise plates. Flux deliverer 1206 delivers flux to field shaper 1202 from electromagnet 1208. Flux receiver 1210 retrieves flux from field shaper 1204 using electromagnet 1212. The bias magnetic field is spatially uniform and over the region between field shaper 1202 and field shaper 1204.

Figure 13:
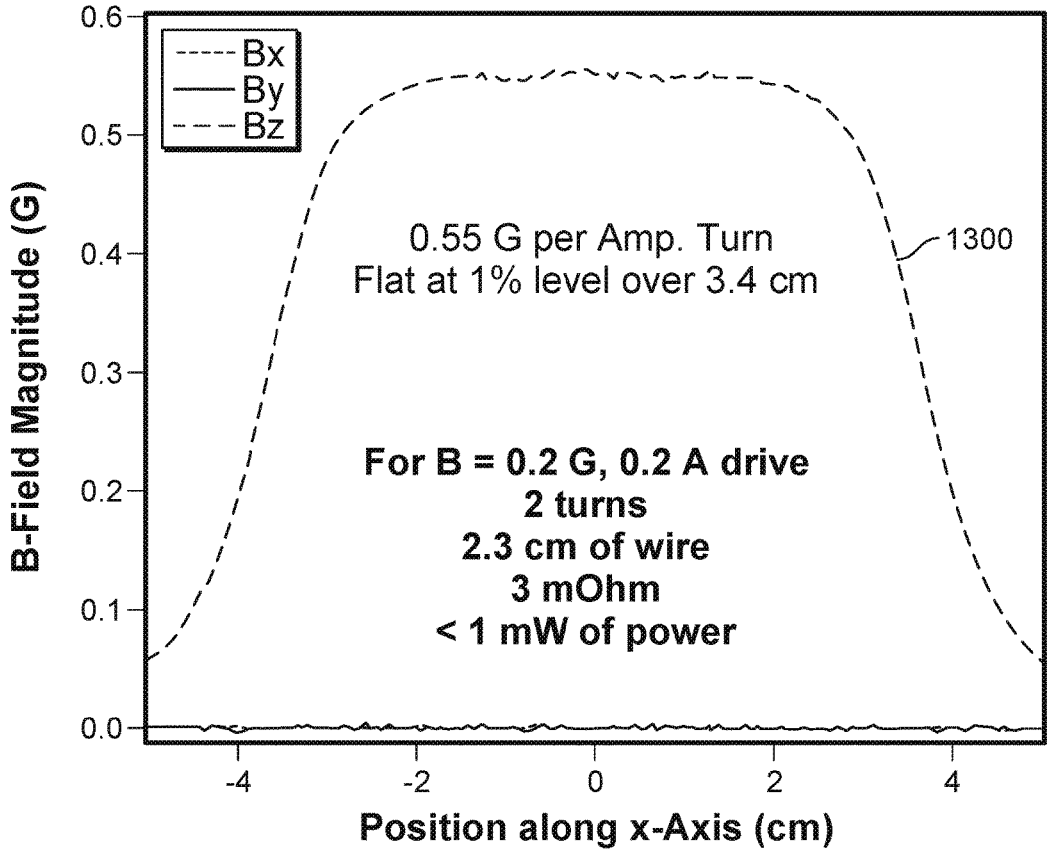
FIG. 13 is a graph illustrating an embodiment of a magnetic field from a magnetic field generation device.

FIG. 13 is a graph illustrating an embodiment of a magnetic field from a magnetic field generation device. In some embodiments, the diagram of FIG. 13 is associated with a device as in FIG. 10. In the example shown, the device generates a uniform magnetic field (e.g., B field about 0.55 G per amp-turn that is flat at 1% level over 3.4 cm). Trace 1300 graphs magnitude of the magnetic field in the z-direction. In some embodiments, for B=0.2 G, 0.2 A drive currents in 2 turns of 2.3 cm of wire with 3 mOhms of resistance consume <1 mW of power.

In some embodiments, B fields generated are 0-5 G.

Figure 14:
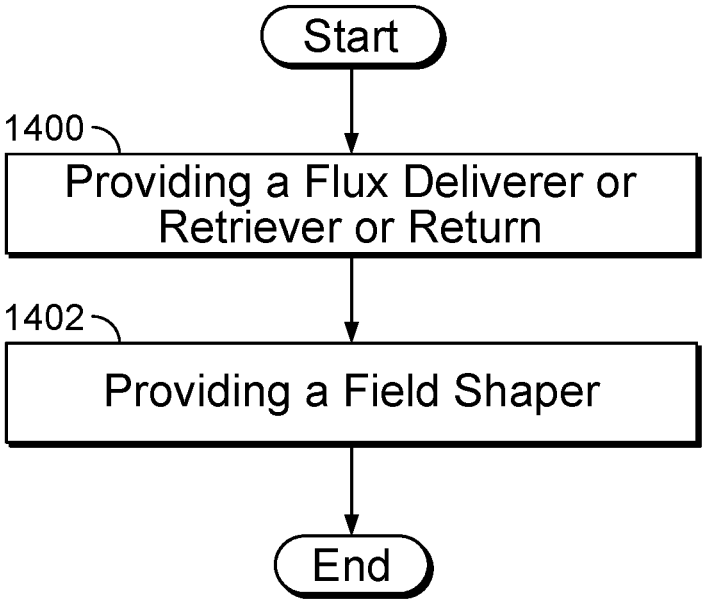
FIG. 14 is a flow diagram illustrating an embodiment of a process for providing a magnetic field generator.

FIG. 14 is a flow diagram illustrating an embodiment of a process for providing a magnetic field generator. In some embodiments, the process of FIG. 14 is used to provide a magnetic field generator (e.g., a device as in FIG. 1, FIG. 4, or FIG. 10). In the example shown, in 1400 a flux deliverer or retriever or return is provided. In 1402, a field shaper is provided. In some embodiments, the flux deliverer or retriever or return and or flux shaper is made from a high magnetic permeability material. In various embodiments, the high magnetic permeability material comprises mumetal, permalloy, or any other material. In some embodiments, a flux deliverer delivers or a flux receiver returns magnetic flux generated using an electromagnet. In some embodiments, the electromagnet is remote from the field shaper. In some embodiments, the electromagnet comprises wire coiled around the flux deliverer. In some embodiments, the electromagnet is outside the vacuum chamber. In some embodiments, the electromagnet is inside a vacuum chamber. In some embodiments, the field shaper is shaped to make a desired magnetic field (e.g., a dipole magnetic field, a spherical quadrupole magnetic field, a bias field, etc.). In various embodiments, the field shaper is shaped as a cylinder, one or more flat plates, a cylinder with apertures (e.g., at the ends of the cylinder, equispaced at angles around the circumference of the cylinder walls, to enable orthogonal optical access to the center of the shape, etc.), a sphere, or any other appropriate shape. In some embodiments, a field shaper is inside of a vacuum chamber. In some embodiments, a field shaper is outside a vacuum chamber.

In some embodiments, the magnetic field generator comprises a quadrupole magnetic field generator. For example, the quadrupole magnetic field used with a 2D MOT. In some embodiments, a quadrupole magnetic field generator uses bias plates with opposed drive currents, meaning the flux delivers send flux with the same rather than opposite polarity into the field shapers. The flux delivers are arranged symmetrically above and below the field plates. The extra delivers (relative to the standard bias plates) eliminate offsets for the field null that otherwise appear in the case of "one-sided" or non-symmetric delivery. In some embodiments, a quadrupole magnetic field generator uses an extended cylinder with access holes for elliptical-footprint 2D MOT optical beams. It's similar to the 3D MOT field generator of FIG. 4, but with a larger length/diameter ratio. This design also uses symmetrically placed flux delivers to remove spatial offsets between the field null and the symmetry axis of the cylinder.

In some embodiments, the magnet flux source (e.g., electromagnet or permanent magnet) distance from the field shaper depends on a material-dependent parameter known as the reluctance. The reluctance plays a role in magnetic circuits similar to resistance in electrical circuits. The analogy is not perfect in that the reluctance determines how much flux is lost per unit length—higher reluctance translates into greater loss. One way to overcome this limitation for distantly electromagnets is to add turns to the electromagnets or increase the drive currents. This approach eventually has diminishing return, in part due to saturation of the high permeability material. In some embodiments, the field generators are designed for transmission distances of a few inches (e.g., 0-5 inches) where the non-zero reluctance has a relatively small impact on the delivered flux.

In some embodiments, the magnetic field generators are approximately 0.5-3 cm×0.5-3 cm×0.5-3 cm. In some embodiments, the bias field generators are approximately 1-2 cm×25-30 cm.

Although the foregoing embodiments have been described in some detail for purposes of clarity of understanding, the invention is not limited to the details provided. There are many alternative ways of implementing the invention. The disclosed embodiments are illustrative and not restrictive.

What is claimed is:

1. A device for magnetic field generation, comprising:

a flux deliverer; and a field shaper, wherein the field shaper is shaped to generate a spherical quadrapole magnetic field, wherein the field shaper has a cylindrical shape, wherein the cylindrical shape includes circular apertures on opposite side of a center of the cylindrical shape, and wherein the circular apertures are on opposite sides along 3 orthogonal axes of the cylindrical shape.

2. A device as in claim 1, wherein the flux deliverer comprises a high magnetic permeability material.

3. A device as in claim 2, wherein the high magnetic permeability material comprises mu metal or permalloy.

4. A device as in claim 1, wherein the flux deliverer delivers or a flux receiver returns magnetic flux generated using an electromagnet.

5. A device as in claim 4, wherein the electromagnet is remote from the field shaper.

6. A device as in claim 4, wherein the electromagnet comprises wire coiled around the flux deliverer.

7. A device as in claim 4, wherein the electromagnet is inside or outside of a vacuum chamber.

8. A device as in claim 4, wherein the flux deliverer or receiver is inside or outside of a vacuum chamber.

9. A device as in claim 4, wherein a flux shaper is inside or outside of a vacuum chamber.

10. A device as in claim 1, wherein the field shaper comprises a high magnetic permeability material.

11. A device as in claim 10, wherein the high magnetic permeability material comprises mu metal or permalloy.

12. A device as in claim 1, wherein the field shaper is inside of a vacuum chamber.

13. A device as in claim 1, wherein the field shaper is outside of a vacuum chamber.

14. A device as in claim 1, wherein the flux deliverer delivers or a flux receiver returns magnetic flux generated using a permanent magnet.

15. A method for generating a magnetic field, comprising:

providing a flux deliverer; and providing a field shaper, wherein the field shaper is shaped to generate a spherical quadrapole magnetic field, wherein the field shaper has a cylindrical shape, wherein the cylindrical shape includes circular apertures on opposite side of a center of the cylindrical shape, and wherein the circular apertures are on opposite sides along 3 orthogonal axes of the cylindrical shape.

* * * * *